United States Patent [19]

Hutchison

[11] Patent Number: 4,870,945

[45] Date of Patent: Oct. 3, 1989

[54] SPRING PISTON AIR WEAPON

[76] Inventor: Roy Hutchison, 55 Dale View Ave., Chingford, England, E4

[21] Appl. No.: 184,935

[22] Filed: Apr. 22, 1988

[30] Foreign Application Priority Data

Apr. 10, 1985 [GB] United Kingdom ..... 8525227

[51] Int. Cl.[4] ..... F41B 11/00

[52] U.S. Cl. ..... 124/68; 124/64

[58] Field of Search ..... 124/64, 65, 66, 67, 124/68, 43, 56; 417/488; 92/75, 76, 137

[56] References Cited

U.S. PATENT DOCUMENTS

| | | | |
|---|---|---|---|
| 2,938,513 | 5/1960 | Giss | 124/68 |
| 3,233,602 | 2/1966 | Partanen | 124/68 |
| 3,709,105 | 1/1973 | Ridley | 92/137 |
| 3,940,887 | 3/1976 | Slaybaugh | 92/137 |

FOREIGN PATENT DOCUMENTS

| | | | |
|---|---|---|---|
| 2205973 | 8/1973 | Fed. Rep. of Germany | 124/68 |
| 728082 | 4/1955 | United Kingdom | 124/68 |
| 2181524 | 4/1987 | United Kingdom . | |

*Primary Examiner*—Randolph A. Reese
*Assistant Examiner*—Anthony Knight
*Attorney, Agent, or Firm*—Fleit, Jacobson, Cohn, Price, Holman & Stern

[57] ABSTRACT

A spring piston air rifle comprises a pair of mutually opposed pistons working in a common cylinder. The pistons are interconnected by a flexible connecting chain to ensure conjoint movement of the pistons. To prepare the weapon for firing, the pistons are forced away from each other compressing one or more springs until a trigger mechanism latches on to a surface associated with one of the pistons. When the trigger mechanism is released the pistons move rapidly towards each other under the influence of the compressed spring, thereby compressing gas to propel a pellet from the rifle. The conjoint movement of the pistons towards each other produces a substantially recoiless action.

5 Claims, 1 Drawing Sheet

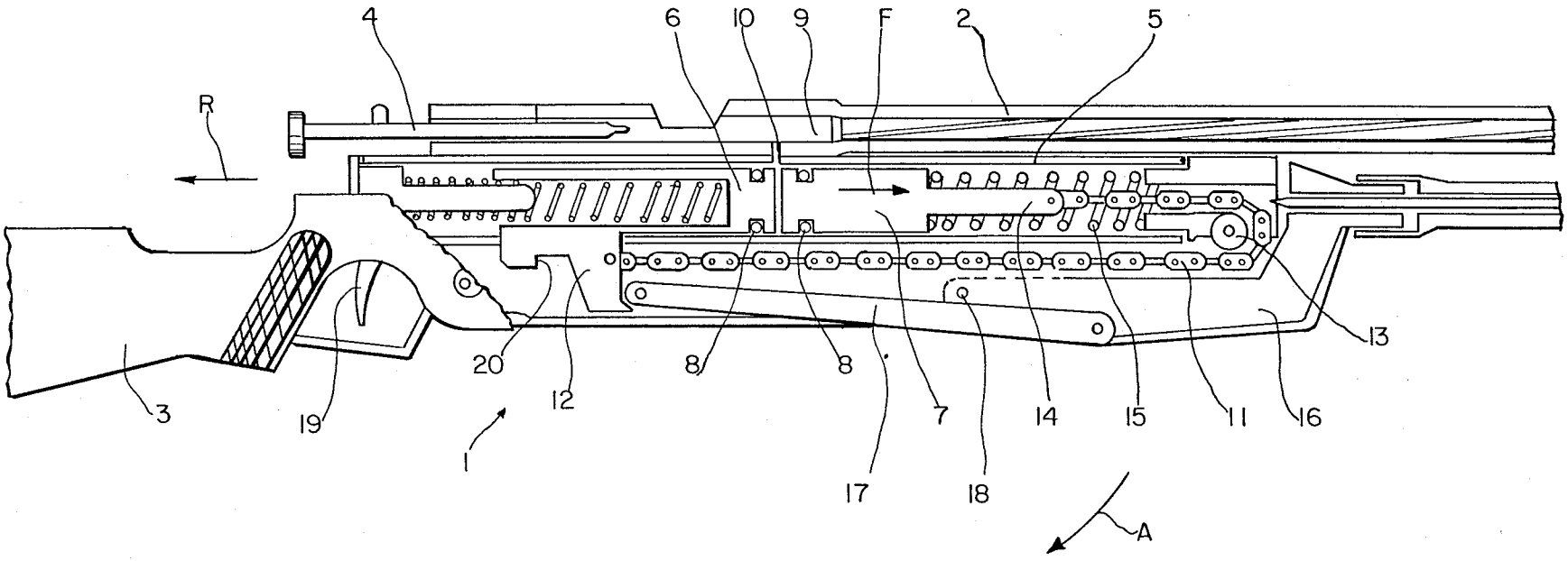
13
16
11
5
15
A
14
2
18
7
F
17
9
8
10
8
6
12
20
1
4
19
R
3

SPRING PISTON AIR WEAPON

This invention relates to an air weapon and in the preferred embodiment provides a spring piston air weapon which is substantially recoiless and will operate at high power.

In the usual design of spring piston air weapons a single piston is driven by a compressed spring to compress air which then propels a projectile from the weapon. When the weapon is cocked the piston is held in a rearward position against the force of its spring, and when the trigger is released the piston moves rapidly forward under influence of the spring. At least a substantial portion of the movement of the piston occurs before the projectile has left the weapon. Accordingly, recoil forces induced by movement of the piston are liable to cause movement of the weapon before the projectile leaves the weapon, which can reduce the accuracy of the weapon.

With a view to minimizing this problem it has been proposed to furnish an air weapon with two horizontally opposed pistons of equal weight which are released simultaneously by the trigger and move in opposite directions thereby substantially cancelling the recoil effect associated with a single piston. However, previous horizontally opposed piston designs have not been practicable because of the difficulties of coordinating movement of the pistons, and in particular simultaneously releasing the pistons, and ensuring that the pistons move at equal and opposite velocities during the pressure generating stroke.

According to the present invention there is provided an air weapon comprising a pair of pistons at least one of which is spring loaded so that when the pistons are released from a cocked position the pistons are driven by the spring or springs and at least one of the pistons is operative to compress propellant air, wherein the pistons are linked together by flexible connecting means constraining the pistons to move in opposite directions at equal and opposite velocities upon actuation of the trigger.

With such an arrangement, the trigger mechanism can be arranged simply to engage means of or on one of the pistons or on the flexible connecting means, and upon release of the trigger the flexible connecting means will ensure the desired conjoint movement of the pistons. It is not necessary to provide a complex mechanism for providing simultaneous release of the pistons upon actuation of the trigger.

Preferably, the pistons are mounted in a common cylinder and move towards each other during pressure generating strokes. With such an arrangement, the flexible connecting means may comprise a flexible member which is connected to the axially outer end of one piston, passes around a pulley, and is connected to the other piston via a connecting block secured to the other piston and extending radially outwardly through a slot provided in the cylinder wall. With such an arrangement, the trigger can conveniently be arranged to latch on to the connecting block.

One or both pistons may be provided with a suitable compression spring to drive the pistons in the required direction. In the event that one only of the pistons is provided with a spring, it is preferably the piston to which the flexible connecting means is connected on the axial side opposite the pressure generating space. Such an arrangement, combined with a trigger which latches on to the connecting block associated with the other piston, provides a particularly simple and convenient arrangement. Preferably, the cocking lever of the weapon is associated with the piston having the connecting block, and with such an arrangement the movement of both pistons is at all times positively controlled.

The pistons may, if desired, be separated by a central partition which divides the common cylinder into separate parts. However, in the preferred embodiment there is no partition separating the pistons, and both pistons are sealed to the surface of the cylinder by suitable sealing means, for example, O-ring seals.

The invention will be better understood from the following description of a preferred embodiment thereof, given by way of example only, reference being had to the accompanying drawing wherein the single Figure is a schematic cross-sectional view of a weapon embodying the present invention.

Referring to the drawing the air weapon 1 comprises a barrel 2 and stock 3, and a conventional bolt arrangement 4 permitting the insertion of a pellet into the breech 9 of the weapon. Mounted beneath the barrel 2 is a cylinder 5 in which is mounted a pair of pistons 6,7. Each piston is furnished with an O-ring seal 8 whereby the pistons are in sliding sealing contact with the walls of the cylinder and define therebetween a space which is connected to the barrel by means of a suitable port 10. In use, air within the space between the pistons is compressed by movement of the pistons towards each other, and the compressed air is communicated via the port 10 to the breech of the weapon to propel the pellet from the weapon.

To ensure controlled conjoint movement of the pistons 6,7 a chain 11 is connected to the rearward piston 6 via a connecting block 12 welded to the piston 6, and extends forwardly around a pulley 13 to the axially outward (forward) end 14 of the piston 7 where it is connected to the piston 7 by means of an adjustable screw connection which may be adjustable to compensate for variations in the length of the chain. A powerful compression spring 15 biases the piston 7 rearwardly. The normal rest configuration the pistons is as illustrated in the drawing.

In order to fire the weapon, a cocking lever 16 which is in contact with the rear piston 6 by a strut 17 is rotated about its pivot 18 in the direction of arrow A to force the rearward piston 6 in the direction of the arrow R - i.e. rearwardly of the weapon. Movement of the piston 6 is transmitted by the chain 11 to the forward piston 7 and causes that piston to move in the direction of the arrow F, i.e. forwardly of the weapon. When the rearward piston 6 has been moved sufficiently it will be latched in a cocked position by the trigger mechanism 19 which engages a suitable surface 20 provided on the connecting block 12 for this purpose.

To fire the weapon the trigger is pulled to disengage the trigger mechanism from the connecting block and permit the pistons to be moved forcefully towards each other by the spring 15 thereby compressing air within the space between the pistons and driving the pellet from the weapon. By suitably coordinating the mass of the various moving parts the movement of the pistons can be substantially recoiless.

Whilst in the illustrated embodiment of the invention the connecting means is in the form of a chain it will be appreciated that other flexible connecting means may be utilized, for example a flexible steel wire rope. Further, although in the illustrated embodiment both pistons are sealed to the cylinder and there is no partition between the pistons, as an alternative a partition may be provided at a point mid way between the pistons, and in this case only one piston 6 need be sealed to the cylinder, and the piston 7 will need no "O" ring and will purely be acting as a counterbalance weight. Piston 7 must always be pulling piston 6 in order to keep the chain under tension. With such an arrangement, the zone between the sealed piston and the partition is used to compress the propellant air.

I claim:

1. A spring piston air weapon, comprising:

a first piston running in a cylinder, said cylinder having a slot in a wall thereof;

a connecting block secured to the first piston, said connecting block extending radially outwardly through the slot in the cylinder wall;

a pulley;

a second piston running in a cylinder;

spring means for urging the second piston towards the first piston;

a trigger mechanism having a trigger and a latch operated by said trigger for engaging a surface associated with one of the first and second pistons for latching said one piston in a cocked position; and a flexible connecting means connected at one end thereof to the connecting block and extending therefrom around the pulley to an axially outer end of the second piston, the flexible connecting means being connected at another end thereof to said axially outer end of said second piston;

whereby, when the trigger is operated to release the latch, the second piston will be urged by the spring means toward the first piston and the first piston will be constrained by the flexible connecting means to move in an opposite direction to the second piston at substantially equal and opposite velocity, at least one of the first and second pistons being operative during such movement to compress propellant gas in the cylinder.

2. An air weapon according to claim 1, wherein the latch engages a surface of the connecting block.

3. An air weapon according to claim 1 wherein the flexible connecting means comprises a chain.

4. An air weapon according to claim 1, wherein the first and second pistons run in a common cylinder.

5. An air weapon according to claim 1 wherein means are provided for forming an airtight seal between each respective piston and cylinder wall, and wherein a space between the pistons constitutes a chamber in which gas is compressed, said chamber being connected to a barrel of the weapon by a port formed in the wall of the cylinder.

* * * * *